United States Patent [19]

Degelmann

[11] Patent Number: 4,851,979

[45] Date of Patent: Jul. 25, 1989

[54] LIGHT DIFFUSER MOUNTING SYSTEM

[75] Inventor: Paul G. Degelmann, Americus, Ga.

[73] Assignee: Cooper Industries, Inc., Houston, Tex.

[21] Appl. No.: 207,417

[22] Filed: Jun. 16, 1988

[51] Int. Cl.[4] ..... F21V 11/06

[52] U.S. Cl. ..... 362/290; 362/260; 362/457

[58] Field of Search ..... 362/217, 223, 260, 290, 362/354, 374, 457

[56] References Cited

U.S. PATENT DOCUMENTS 4,613,929 9/1986 Totten ..... 362/354 X 4,747,027 5/1988 Rieger ..... 362/217

*Primary Examiner*—Stephen F. Husar

*Attorney, Agent, or Firm*—Alan R. Thiele; Eddie E. Scott

[57] ABSTRACT

A fluorescent lamp fixture having a troffer and a louver light diffuser includes meltable fasteners for attaching the louver light diffuser to the troffer. In the event of a fire, the meltable fasteners allow the louver light diffuser to fall free from the troffer.

5 Claims, 2 Drawing Sheets

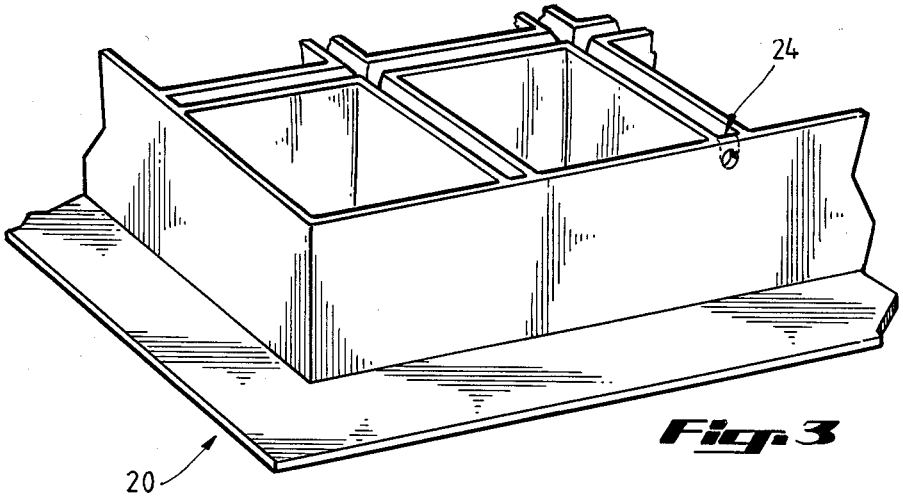
Fig. 3
Fig. 4
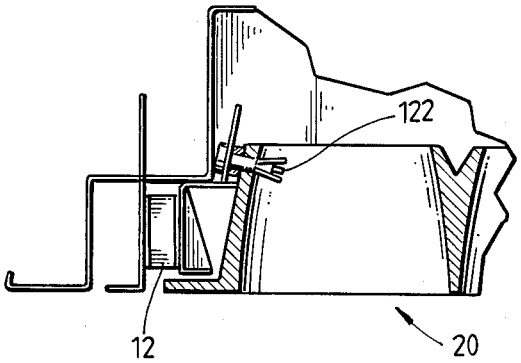
Fig. 5
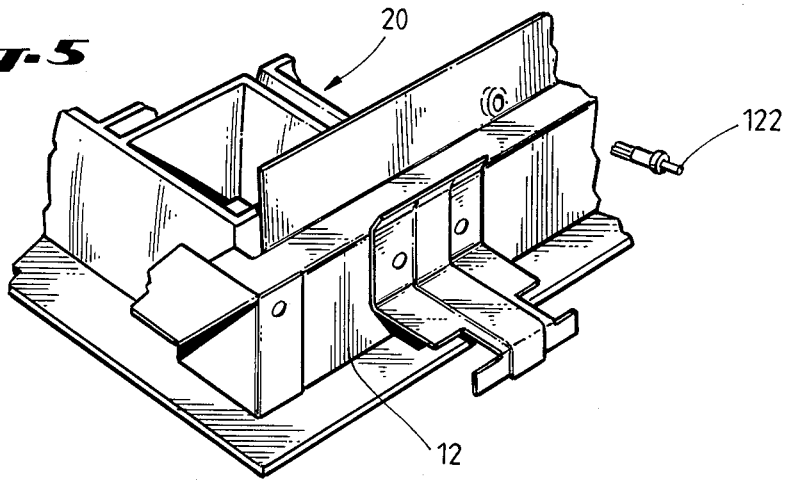

LIGHT DIFFUSER MOUNTING SYSTEM

BACKGROUND OF THE INVENTION

The present invention relates to fluorescent troffers; more particularly, the present invention relates to a method of mounting a louver light diffuser in a fluorescent troffer.

Fluorescent light fixtures typically include a channel-shaped troffer which provides for the mounting of fluorescent lamp tubes and a louver light diffuser which is connected to the troffer. The louver light diffuser spreads the light from the fluorescent lamps over a wide area. Occupants of a room normally see the louver light diffuser when looking upward at troffers which are mounted within or hang from a ceiling.

In the event of a fire, it is necessary that the louver light diffuser fall free from the troffer. The reason for such separation is that if the louver light diffuser catches fire, flames may quickly spread among the various fluorescent fixtures mounted in a ceiling. The need for louver light diffusers to fall free from the fluorescent troffers has now been codified in UL standard #1570 entitled "Standards for Safety of Fluorescent Lighting Equipment." In compliance with article 51 of this UL standard, manufacturers of fluorescent troffers must provide a system which allows the louver light diffuser to fall free from the troffer prior to the ignition point of the louver light diffuser.

There is therefore a need in the art to provide a method for mounting light diffusers to troffers so that the diffusers will fall free from the fluorescent troffer in the event of a fire.

SUMMARY OF THE INVENTION

An improved method for mounting light diffusers to troffers for fluorescent lamps includes meltable fasteners. Such meltable fasteners support the attachment of the louver light diffuser to the troffer. In the event of a fire, the melting of the meltable fasteners by the heat of the flames allows the louver light diffuser to fall free from the troffer.

BRIEF DESCRIPTION OF THE DRAWINGS

A better understanding of the louver light diffuser mounting system of the present invention may be had by reference to the figures wherein:

FIG. 3 is a top perspective view of a diffuser;

FIG. 4 is a side elevational view in partial section of an alternate embodiment of the present invention;

FIG. 5 is an enlarged top perspective view of the alternate embodiment shown in FIG. 4.

BRIEF DESCRIPTION OF THE EMBODIMENTS

Figure 1:
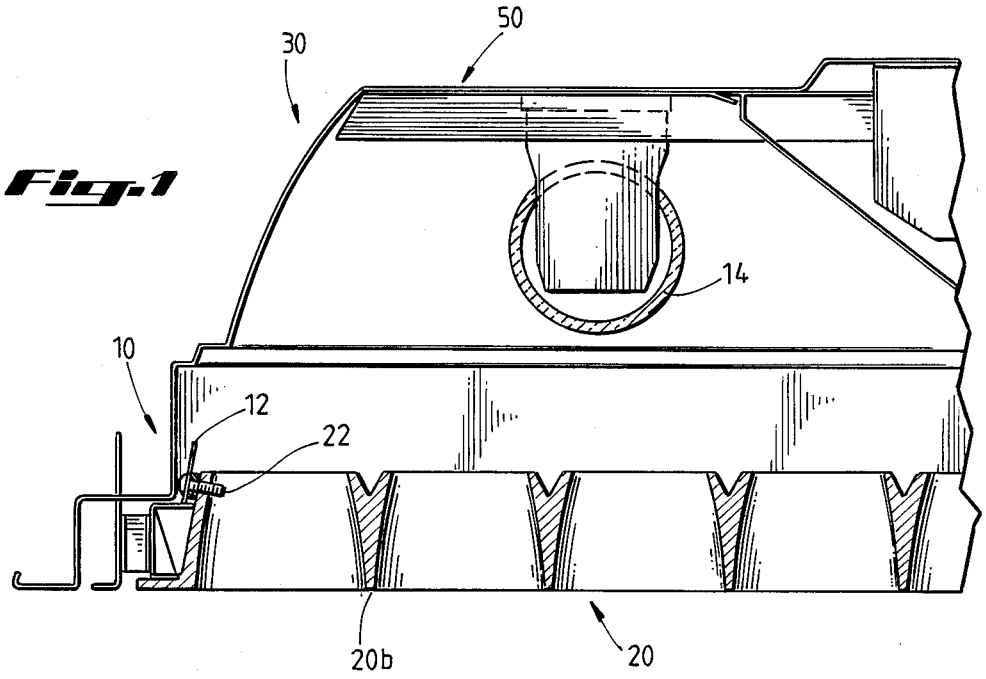
FIG. 1 is an end view in partial section of a fluorescent light troffer frame and louver light diffuser.
Figure 2:
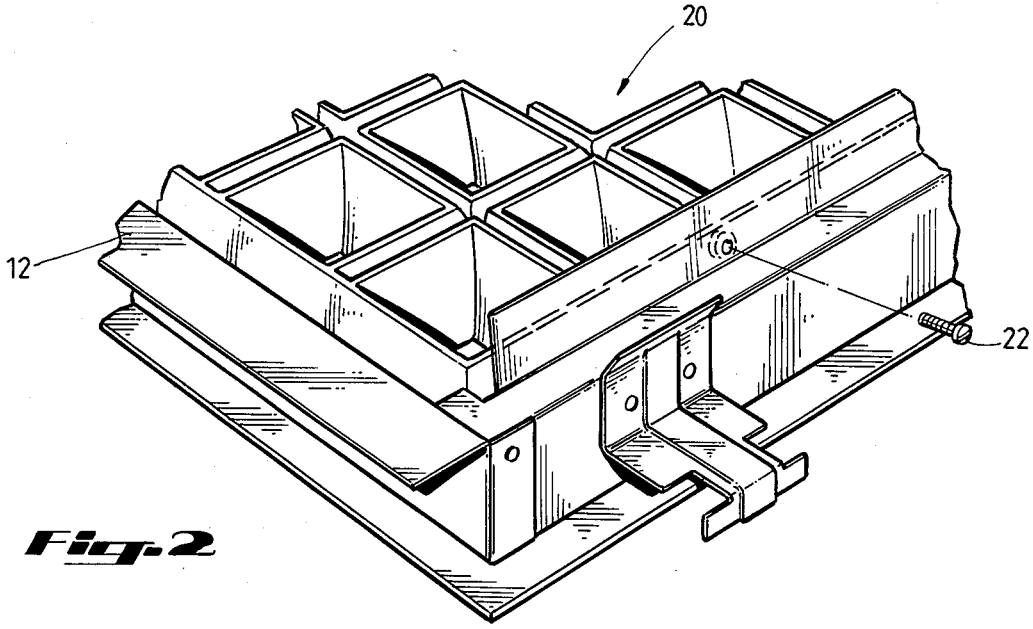
FIG. 2 is an enlarged top perspective view of a louver light diffuser mounted to a fluorescent troffer.

A better understanding of the light diffuser mounting system 10 of the present invention may be had by reference to FIGS. 1, 2 and 3. Therein it may be seen that a fluorescent light fixture 30 includes a troffer 50, a louver light diffuser 20, and frame 12. Frame 12 mounts diffuser 20 to troffer 50. Light diffuser 20 consists of a plurality of rectangles. These rectangles diffuse the light that emanates from fluorescent lamp tube 14. Diffusers 20 are normally viewed from their bottom side **20*b*** by the occupants of a room.

As may be seen in FIG. 2 louver light diffuser 20 mounts to frame 12 by a plurality of fasteners 22. As shown in FIG. 3 it has been discovered that if the portion 24 of louver tight diffuser 20 above fastener 22 is formed from a meltable plastic, louver light diffuser 20 will fall away from frame 12 in the event of a fire.

In an alternate embodiment of the invention shown in FIGS. 4 and 5, it may be seen that metallic fasteners 22 have been replaced by rivets 122 formed of meltable nylon. Such replacement eliminates the need for including a meltable portion 24 in diffuser 20. In the event of a fire, meltable rivets 122 becomes soft and no longer provides the required support thus allowing the louver light diffuser 30 to fall free from frame 12.

There is thereby provided by the louver light diffuser mounting system 10 of the present invention a system wherein the louver light diffuser 30 will fall free from the fluorescent troffer 50 in the event of a fire.

Having described the embodiments of the present invention, those skilled in the art, having the benefit of said descriptions and the accompanying drawings may readily devise other embodiments and modifications. Such other embodiments and modifications are considered to be within the scope of the appended claims.

What is claimed is:

1. A system for allowing a louver light diffuser to fall free from a troffer in the event of a fire, said system comprising:

a plurality of metallic fasteners for attaching the louver light diffuser to the troffer;

a meltable insert placed in said louver light diffuser above each of said fasteners;

whereby in the event of a fire said meltable inserts will melt and allow said louver light diffuser to fall free from the troffer.

2. A fluorescent lamp fixture for mounting in a ceiling:

a troffer constructed and arranged to mount at least one fluorescent lamp tube;

a louver light diffuser constructed and arranged to mount to said troffer;

a plurality of meltable fasteners for attaching said louver light diffuser to said troffer.

3. The lamp fixture as defined in claim 2 wherein said fasteners are fabricated from nylon.

4. A method of mounting a louver light diffuser to a troffer for use with fluorescent lights comprising the step of: inserting meltable fasteners through aligned holes in said louver light diffuser and said troffer.

5. The method as defined in claim 4 wherein said meltable fasteners are fabricated from nylon.

* * * * *